US011642566B2

(12) United States Patent
Ellis

(10) Patent No.: US 11,642,566 B2
(45) Date of Patent: May 9, 2023

(54) ADJUSTABLE FOUR-BAR LINKAGE ASSEMBLY EXERCISE STATION

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 261 days.

(21) Appl. No.: 16/935,745

(22) Filed: Jul. 22, 2020

(65) Prior Publication Data

US 2022/0023707 A1 Jan. 27, 2022

(51) Int. Cl.
*A63B 21/00* (2006.01)
*A63B 23/12* (2006.01)
(Continued)

(52) U.S. Cl.
CPC ..... *A63B 21/4047* (2015.10); *A63B 22/0002* (2013.01); *A63B 23/12* (2013.01); *A63B 23/1209* (2013.01); *A63B 23/1263* (2013.01); *A63B 21/00* (2013.01); *A63B 21/005* (2013.01); *A63B 21/008* (2013.01); *A63B 21/06* (2013.01); *A63B 21/15* (2013.01); *A63B 21/151* (2013.01); *A63B 21/157* (2013.01); *A63B 21/159* (2013.01); *A63B 21/225* (2013.01);
(Continued)

(58) Field of Classification Search
CPC ..... A63B 21/4047; A63B 21/4035; A63B 21/159; A63B 21/00; A63B 23/1209; A63B 23/1263; A63B 22/0002–0005; A63B 22/001–0012; A63B 21/078; A63B 21/15; A63B 21/4033; A63B 23/1218; A63B 21/005; A63B 21/008; A63B 21/06; A63B 21/151; A63B 21/157; A63B 21/225; A63B 21/062; A63B 21/0615–0617; A63B 22/0005; A63B 22/0015; A63B 22/0046; A63B 22/0048; A63B 22/0076; A63B 23/12–1209; A63B 23/035–03525; A63B 23/1245; A63B 23/1281; A63B 2208/0233; A63B 2225/682; A63B 69/06; A63B 69/04; A63B 2069/064–066; A63B 2022/0082–0084
See application file for complete search history.

(56) References Cited

U.S. PATENT DOCUMENTS 5,362,297 A * 11/1994 Muir ..... A63B 23/12 482/137
5,437,589 A * 8/1995 Habing ..... A63B 23/03541 482/136
(Continued)

*Primary Examiner* — Garrett K Atkinson
*Assistant Examiner* — Kathleen M Fisk
(74) *Attorney, Agent, or Firm* — Laurence P. Colton; Smith Tempel Blaha LLC

(57) ABSTRACT

A four-bar linkage assembly exercise station that can be adjusted to various configurations to create various exercise motions having at least one adjustable operational pivot that is movable prior to operation of the machine and stationary during operation of the machine and at least one stationary adjustment pivot operatively connected to the at least one adjustable operational pivot. The stationary adjustment pivot is also operatively connected to an adjusting and latching component or assembly that can be engaged by a user prior to operation of the machine to adjust the four-bar linkage assembly exercise station to a desired configuration to create a unique exercise motion and secure the desired configuration of the adjustable four-bar linkage assembly.

14 Claims, 11 Drawing Sheets

(51) Int. Cl.

| | |
|---|---|
| ***A63B 22/00*** | (2006.01) |
| *A63B 21/22* | (2006.01) |
| *A63B 21/008* | (2006.01) |
| *A63B 21/06* | (2006.01) |
| *A63B 21/005* | (2006.01) |

(52) U.S. Cl.
CPC ..... *A63B 21/4033* (2015.10); *A63B 21/4035* (2015.10); *A63B 22/0005* (2015.10); *A63B 23/1218* (2013.01); *A63B 2208/0233* (2013.01); *A63B 2225/682* (2013.01)

(56) References Cited

U.S. PATENT DOCUMENTS 5,580,341 A * 12/1996 Simonson ..... A63B 23/03525 482/136
5,643,147 A * 7/1997 Huang ..... A63B 21/068 482/96
5,928,116 A * 7/1999 Chiang ..... A63B 21/4047 482/133
6,142,917 A * 11/2000 Giannelli ..... A63B 23/1209 482/136
6,254,516 B1 * 7/2001 Giannelli ..... A63B 23/1209 482/136
6,302,833 B1 * 10/2001 Ellis ..... A63B 23/12 482/136
6,746,385 B1 * 6/2004 Habing ..... A63B 23/1209 482/136
6,770,017 B1 * 8/2004 Leipheimer ..... A63B 23/0405 482/99
7,938,761 B2 * 5/2011 Simonson ..... A63B 21/0615 482/136
9,861,850 B1 * 1/2018 Webber ..... A63B 21/00181
11,065,506 B2 * 7/2021 Lin ..... A63B 21/078
2004/0005966 A1 * 1/2004 Chen ..... A63B 23/03566 482/138
2005/0209070 A1 * 9/2005 Greenland ..... A63B 21/078 482/97
2018/0147436 A1 * 5/2018 Ellis ..... A63B 21/00069

* cited by examiner

ADJUSTABLE FOUR-BAR LINKAGE ASSEMBLY EXERCISE STATION

BACKGROUND OF THE INVENTION

Technical Field

This invention relates to the general technical field of exercise, physical fitness and physical therapy equipment and machines. This invention relates more specifically to the field of exercise stations that are operatively connected with a four-bar linkage assembly.

Prior Art

Exercise, physical fitness and physical therapy equipment and machines are available in various configurations and for various purposes, and are available for all of the major muscle groups. Some machines utilize a pivoting four-bar linkage assembly coupled with a user engagement feature such as a handle or platform to create a pushing or pulling exercise motion. Examples of these machines would include a chest press, a leg press, a shoulder press, a back-rowing machine or a back pulldown machine. The four-bar linkage assembly is generally comprised of two spaced apart stationary pivots mounted on the rigid structural frame of an exercise station or machine wherein the structural frame represents the first link. Second and third elongated links are attached to the stationary pivots at first ends and extend away from the two stationary pivots. A fourth link is pivotally coupled to the second ends of the second and third links at spaced apart locations to form a four-sided shape and a user engagement feature is operatively connected to the forth link generally at one end such that the second link, third link, fourth link and the user engagement move in a reciprocating back and forth motion during operation of the machine such that two of the pivots remain stationary on the rigid frame during operation of the machine and two of the pivots move with the reciprocating linkages during operation of the machine.

Generally, a four-bar linkage assembly is used to create a more elongated bio-mechanical exercise motion versus the continuous radius exercise motion of a single pivot. Based on the configuration of the four-bar linkage assembly various unique exercise motions can be created to best match the natural human bio-mechanics of a particular muscle group or sets of muscles.

A four-bar linkage assembly may be utilized on an exercise machine or station for various purposes. One purpose may be to create a somewhat linear motion in a space or plane where it would be difficult to place a linear motion mechanism to transport the user engagement feature. Another purpose would be to create a movement pattern wherein the user engagement feature stayed at or adjusted to a certain angle or angles through the movement pattern to better conform to human motion. The articulating motion of a leg press platform to match the user's ankle motion would be a good example of this. Another purpose would be to create a somewhat linear exercise motion that is less costly to manufacture or would be more durable and require less maintenance than a purely linear mechanism. Four-bar linkage mechanisms can be operatively connected with various types of resistance mechanism to create resistance to the exercise motion. Of the various advantages of utilizing a four-bar linkage assembly for exercise stations or machines, prior art has been limited to creating a single exercise motion per station. The present invention improves upon these features by creating a mechanism that allows the user to easily adjust the configuration of a four-bar linkage assembly such that a single exercise station can be adjusted and reconfigured to create various exercise motions.

BRIEF SUMMARY OF THE INVENTION

The present invention provides an adjustable configuration for a four-bar linkage assembly wherein the location of at least one of the stationary pivots can be unlatched from a first location and moved to a second location and then latched in the second location prior to operation of the exercise station. The adjustable stationary pivot is movably linked to an adjustment pivot that is stationary on the rigid frame of the station and the adjustment pivot does not move during the exercise motion of the adjustable four-bar linkage assembly. The adjustment pivot and adjustable stationary pivot are operatively connected by a linkage bar such that the adjustable stationary link can be adjusted in an orbital pattern about the adjustment pivot while the station is not being operated. The pivoting motion of the adjustment pivot can be latched to a fixed position to keep the adjustable stationary pivot in a fixed location during operation of the station and the pivoting motion of the adjustment pivot can be unlatched when the station is not being operated such that the adjustment pivot can be rotated to move the adjustable stationary pivot to a different location to create a different exercise motion. The adjustable stationary pivot can be adjusted to various locations to create various exercise motions from a single user engagement feature on an exercise station. For example, a chest press station can be reconfigured to a shoulder press station. Another example would be a back-rowing station can be reconfigured to a back pulldown station.

Adjusting the adjustable stationary pivot reconfigures the geometric shape of the four-bar linkage assembly and repositions the user engagement feature. Each variation of these geometric shapes of the adjustable four-bar linkage assembly creates a unique path of motion of the user engagement feature.

The present invention creates multiple exercises with a single exercise station thereby saving cost and reducing space requirements.

All embodiments of the invention can be operatively connected to various mechanisms or components to create resistance to the exercise motions.

DETAILED DESCRIPTION OF PREFERRED EMBODIMENTS

Figure 1:
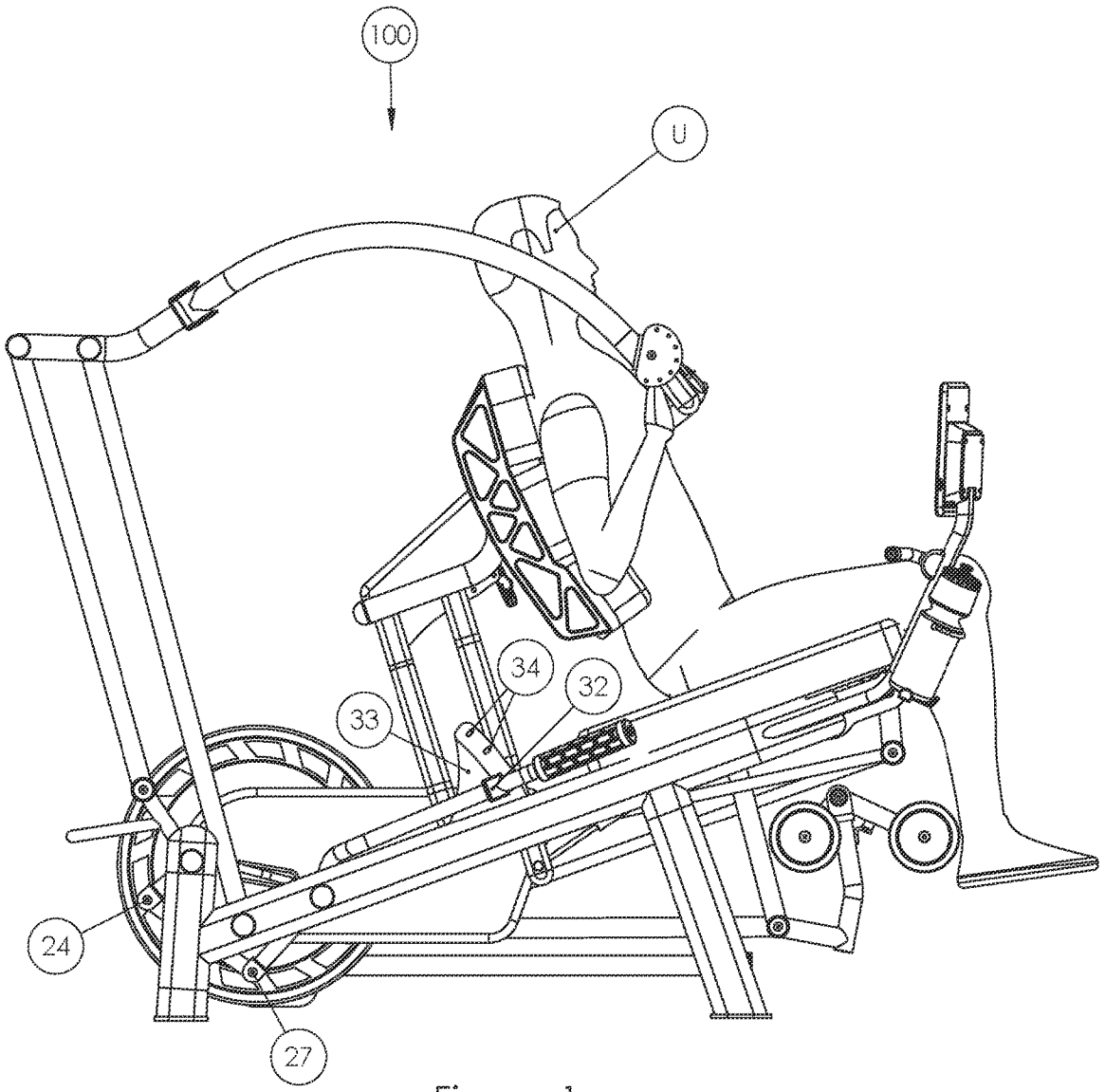
FIG. 1 is a side view of the invention in a first configuration with a user in an exercise position.
Figure 2:
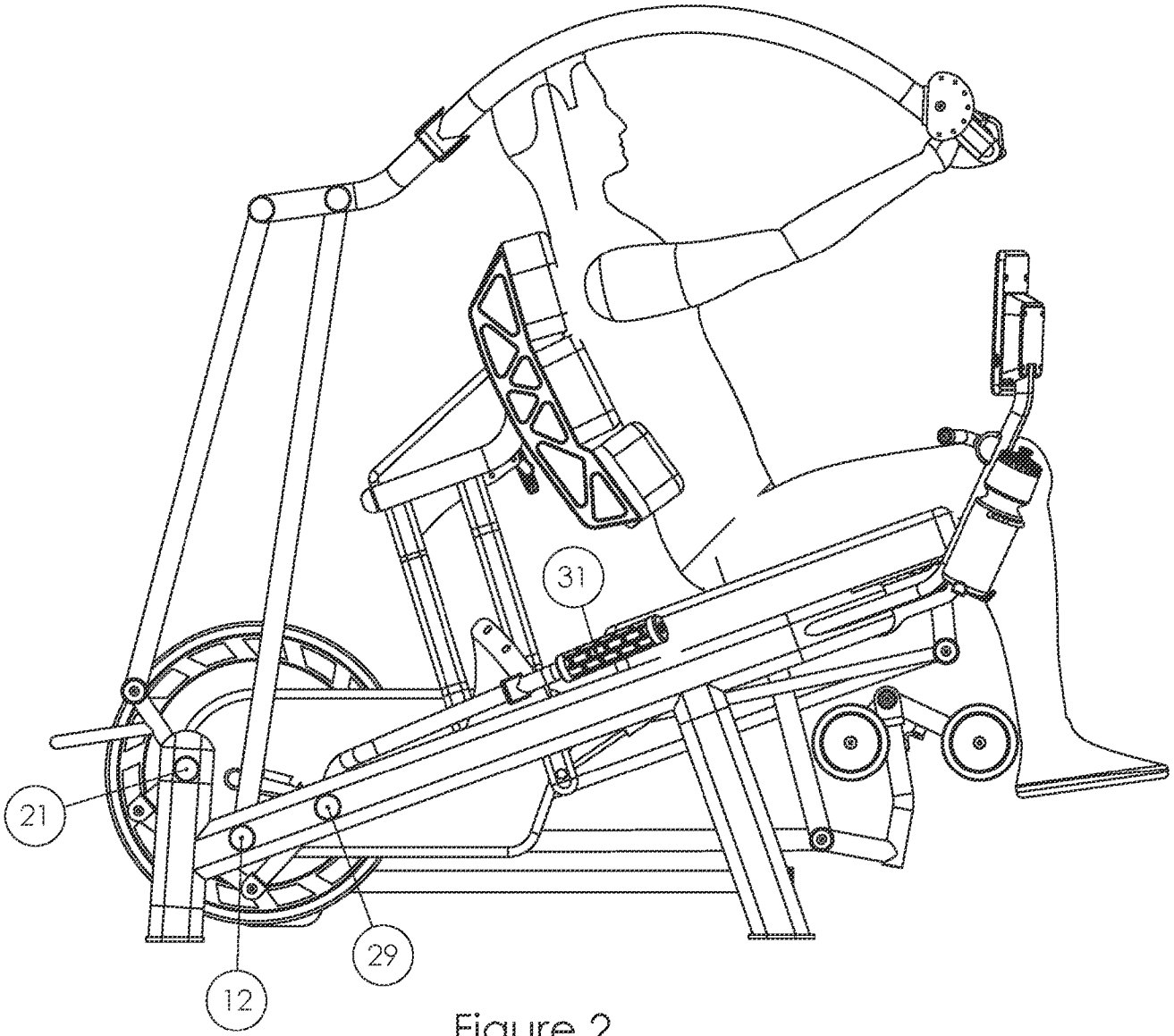
FIG. 2 is a side view of the invention in a first configuration with a user in an exercise position

Exemplary preferred embodiments are disclosed below in connection with the attached drawings. Throughout this specification, various terms will be used to describe various components or features of the invention. For example, the term exercise machine will refer to any machine that can be operatively connected to the invention to create an adjustable motion exercise station. While the drawings are limited to motions that engage the torso muscles, the adjustable four-bar linkage assembly could also be configured to engage muscles in other areas of a user's body such as the arms or legs. The term exercise station refers to the components and assemblies that produce the exercise motion created by the adjustable four-bar linkage assembly and the components and assemblies that adjust the four-bar linkage assembly and the components and assemblies that lock and secure a particular configuration of the four-bar assembly prior to operation of the machine. The term pivot may refer to a bearing, rotary component, or other rotational feature of the invention. The term common axle will refer to a location where two components are coupled and rotate or pivot at the same location. The exercise motion user engagement feature, component or components can include one or more gripping handles, foot platforms, contact pads or combination thereof. The term start or starting point when referring to an exercise motion refers to the proximal location where most users would begin the range of motion of a certain exercise for a certain muscle group. The term finish or finishing point when referring to an exercise motion refers to the proximal location where most users would complete the range of motion of a certain exercise for a certain muscle group. The term resistance mechanism refers to the components of an exercise station or machine utilized to create resistance to the exercise motion of the adjustable four-bar linkage assembly and although only illustrated with a rotational resistance mechanism, the invention will work with all types resistance components and mechanisms including but not limited to weights or stacks of weight, fluid motion assemblies, rotational flywheel and fan assemblies, electrical assemblies and other mechanized resistance systems or combinations thereof including resistance mechanisms that create resistance in the push direction only or the pull direction only or in the push and pull directions of the exercise motion.

Other components of an exercise machine can also be a part of the exercise station including but not limited to the user support components, the resistance mechanism components and user performance information components. Other exercise stations on a single exercise machine can share the common components of the exercise machine such as the user support, resistance mechanism and user performance information components. While the drawings are limited to user support components that place the user in a seated position, the invention could also be operatively connected to an exercise station or machine that places the user in other positions such as standing, prone, supine, kneeling or other exercise positions.

FIGS. 1-11 are all views of embodiments of the invention this inventor terms "An Adjustable Four-Bar Linkage Assembly Operatively Connected To An Exercise Station". Generally, the invention is a device that is operatively connected to an exercise machine for creating various paths of exercise motions for a single user engagement feature at a single exercise station. The invention is an improvement to a four-bar linkage assembly that creates a pushing and or pulling exercise motion such that the pushing or pulling exercise motion can be adjusted to a plurality of unique paths of motion and secured by the user prior to operating the exercise machine. In certain preferred embodiments, the four-bar linkage assembly can be adjusted by the user while the user is located in the exercise position of the exercise station. The components and supporting structure of the invention and exercise machine can be constructed of any material capable of supporting and operating the invention and exercise machine with metal components being the most common component material.

Referring now to FIGS. 1-11, various views and configurations of the device are shown to provide a more complete understanding of the invention. In this embodiment, the components of the adjustable four-bar linkage assembly 1 and the components of the four-bar linkage adjustment and latching assembly 20 are mounted on the structural support frame 101 of machine 100 and adjustable four-bar linkage assembly 1 is operatively connected to resistance mechanism 50 to provide resistance to the exercise motion. The seat pad 60 and back pads 61 are the supports for user U on the exercise station.

As disclosed in the illustrated preferred embodiments, each adjustable four-bar linkage assembly 1 is comprised of a structural support frame 101, a first operational linkage bar 6, a second operational linkage bar 7, a third operational linkage bar 3, a first movable operational pivot 2A, a second movable operational pivot 2B, a first movable operational pivot axle 4A, a second movable operational pivot axle 4B, an adjustable location operational pivot 8, an adjustable location operational pivot axle 9, a stationary operational pivot 12 and a user engagement feature. As previously stated herein, the exercise motion user engagement feature, component or components can be comprised of various components; however, as illustrated herein the exercise motion user engagement component or components includes a user engagement lever arm 10 and a user engagement gripping handle 11, and will be referred to as such herein.

All embodiments of the invention comprise at least one adjustable four-bar linkage assembly 1 and at least one four-bar linkage adjustment and latching assembly 20 and at least one user engagement component. As illustrated herein, the invention can comprise two or more adjustable four-bar linkage assemblies 1 that are somewhat identical opposing adjustable four-bar linkage assemblies 1 that are coupled to cooperate as one and are connected to at least one user engagement feature. Also, as illustrated herein, two or more coupled adjustable four-bar linkage assemblies 1 can be adjusted by a single four-bar linkage adjustment and latching assembly 20. Although not illustrated herein, another embodiment of the invention can comprise independent left and right side adjustable four-bar linkage assemblies 1 that are each operatively connected to a user engagement feature and are each operatively connected to a resistance mechanism. In this embodiment, the left side adjustable four-bar linkage assembly 1 would be operatively connected to a left side adjustable four-bar linkage adjustment and latching assembly 20 and the right side adjustable four-bar linkage assembly 1 would be operatively connected to a right side adjustable four-bar linkage adjustment and latching assembly 20.

In the illustrated preferred embodiments, the components of the adjustable four-bar linkage assembly are assembled such that adjustable location operational pivot 8 is pivotally connected to adjustable location operational pivot axle 9 and a first end of first operational linkage bar 6 is rigidly connected to adjustable location operational pivot 8 and a second end of first operational linkage bar 6 is rigidly connected to first movable operational pivot 2A. Stationary operational pivot 12 is rigidly mounted on structural support frame 101 and a first end of second operational linkage bar 7 is rigidly connected to stationary operational pivot 12 and a second end of second operational link bar 7 is rigidly connected second movable operational pivot 2B. Third operational linkage bar 3 is pivotally connected to first movable operational pivot 2A and pivotally connected to second movable pivot 2B at spaced locations on operational linkage bar 3 with first movable operational pivot axle 4A and second movable operational pivot axle 4B.

At least one user engagement feature such as user engagement lever arm 10 is operatively connected to third operational linkage bar 3. The user engagement feature is preferably connected to third operational linkage bar 3 at a location that is beyond the linear space between the first movable operational pivot axle 4A and second operational pivot axle 4B such that the adjustable path of motion of the user engagement feature can have a greater degree of variation between adjustment settings.

As illustrated herein, two somewhat identical opposing adjustable four-bar linkage assemblies 1 can be coupled to cooperate in one unified motion with a component such as adjustable four-bar linkages connection bar 5 wherein a first end of adjustable four-bar linkages connection bar 5 is rigidly connected to a left side third operational linkage bar 3 and a second end of adjustable four-bar linkages connection bar 5 is rigidly connected to a right side third operational linkage bar 3.

Figure 7:
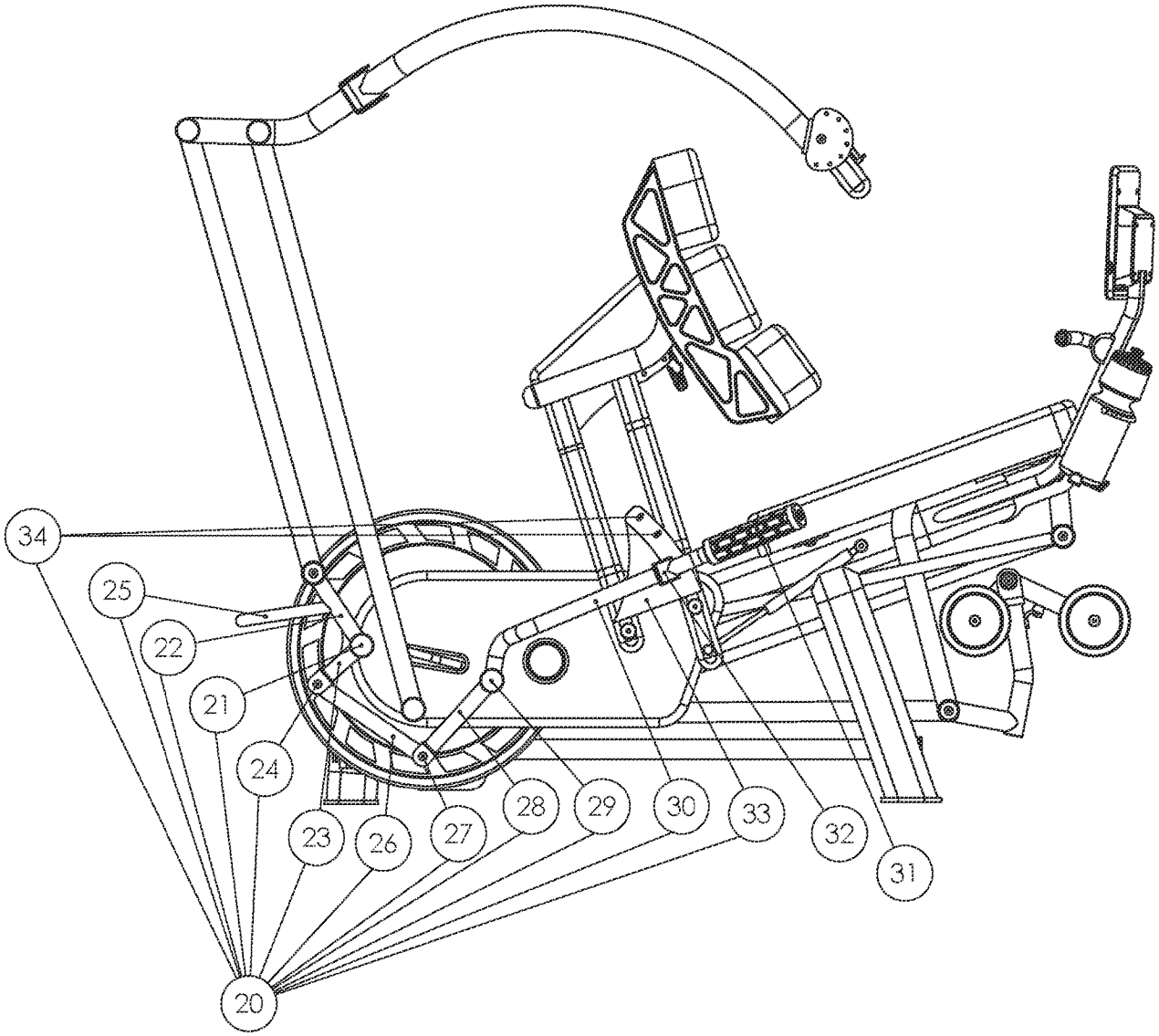
FIG. 7 is a side view of the invention in a first configuration with a portion of the structural support frame removed to illustrate an unobstructed view of certain features.
Figure 8:
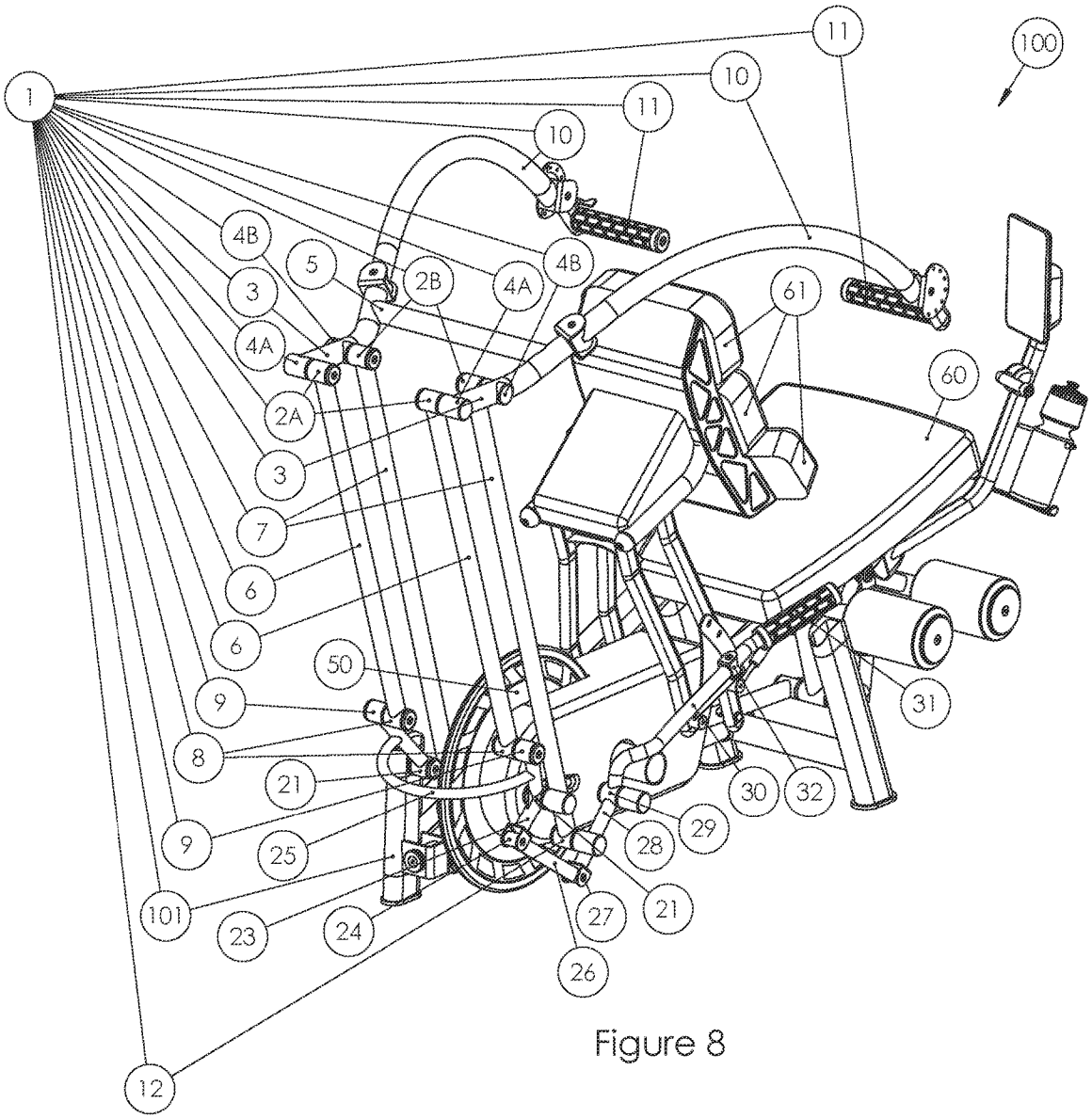
FIG. 8 is a rear perspective view of the invention in a first configurational with a portion of the structural support frame removed to illustrate an unobstructed view of certain features.
Figure 9:
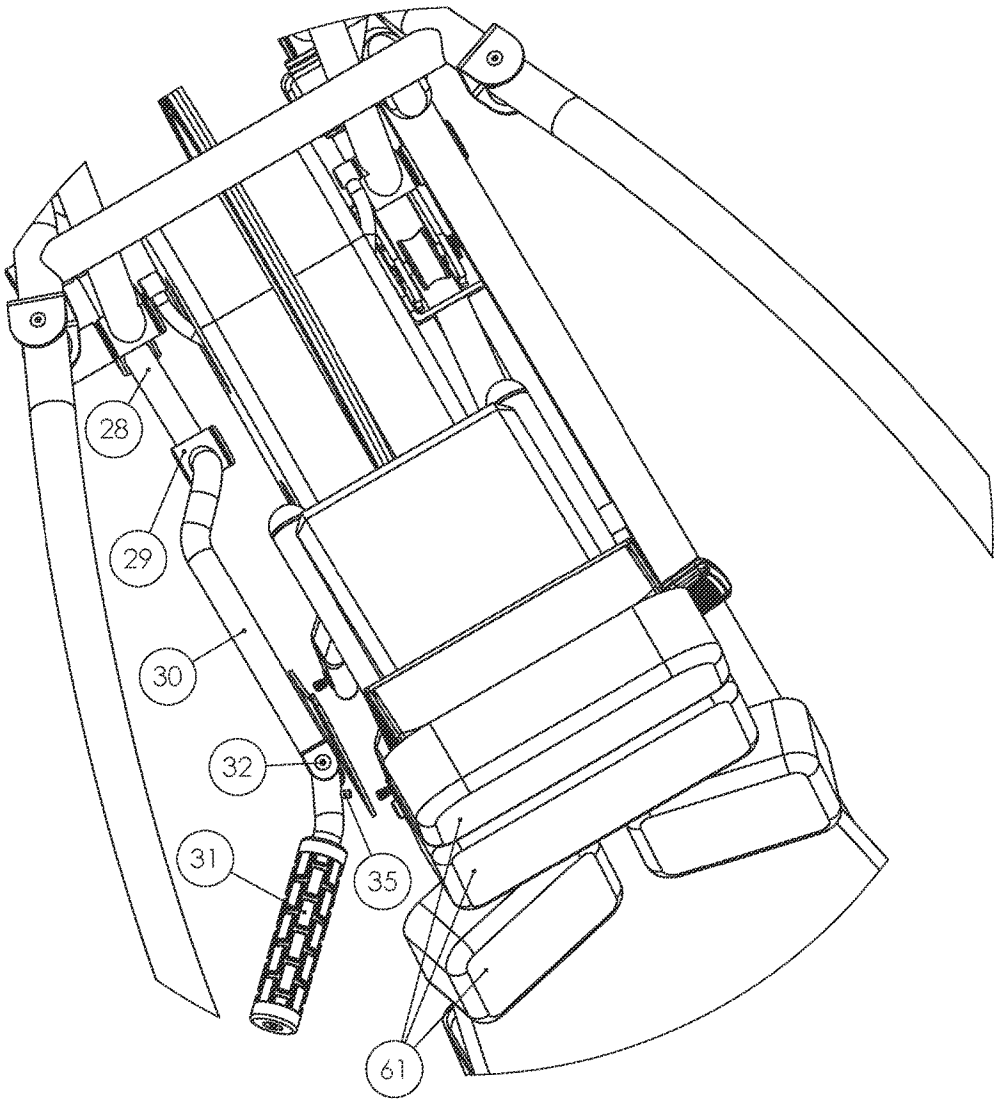
FIG. 9 is an overhead closeup view of the invention to better illustrate certain features.

As best illustrated in FIGS. 7, 8, and 9, the four-bar linkage adjustment and latching assembly 20 is comprised of a left side stationary adjustment pivot 21 and a right side stationary adjustment pivot 21, a left side first adjustment linkage bar 22 and a right side first adjustment linkage bar 22, a second adjustment linkage bar 23, a first movable adjustment pivot 24, an adjustment connection bar 25, a third adjustment linkage bar 26, a second movable adjustment pivot 27, a fourth adjustment linkage bar 28, an adjustment assembly lever pivot 29, an adjustment assembly lever 30, an adjustment assembly handle 31, an adjustment assembly handle pivot 32, an adjustment assembly locking plate 33, an adjustment assembly locking plate detent holes 34, and an adjustment assembly handle detent pin 35. The components of the four-bar linkage adjustment and latching assembly 20 are assembled such that stationary adjustment pivot 21 is rigidly mounted on structural support frame 101 and a first end of first adjustment linkage bar 22 is rigidly connected to stationary adjustment pivot 21 and a second end of first adjustment linkage bar 22 is rigidly connected to adjustable location operational pivot axle 9. Certain embodiments such as illustrated herein comprise somewhat identical opposing left and right side adjustable four-bar linkage assemblies 1 that are coupled to move in unison. Such an embodiment comprises a right side stationary adjustment pivot 21 and a left side stationary adjustment pivot 21 and a right side first adjustment linkage bar 22 and a left side first adjustment linkage bar 22 and a right side adjustable location operational pivot axle 9 and a left side adjustable location operational pivot axle 9. In this embodiment, a first end of an adjustment assembly connection bar 25 may be rigidly connected to a central portion of a right side first adjustment pivot linkage bar 22 and a second end of an adjustment assembly connection bar 25 may be rigidly connected to a central portion of a left side first adjustment linkage bar 22 so as to provide stability to the adjustable four-bar linkages assembly 1 while being adjusted and operated. A first end of second adjustment linkage bar 23 is rigidly connected to stationary adjustment pivot 21 and a second end of second adjustment linkage bar 23 is pivotally connected to a first end of third adjustment linkage bar 26 with first movable adjustment pivot 24. A second end of third adjustment linkage bar 26 is pivotally connected to a first end of fourth adjustment linkage bar 28 with second movable adjustment pivot 27 and a second end of fourth adjustment linkage bar 28 is rigidly connected to adjustment assembly lever pivot 29 which is rigidly mounted on structural support frame 101.

A first end of adjustment assembly lever 30 is rigidly connected to adjustment assembly lever pivot 29 and a second end of adjustment assembly lever 30 is pivotally connected to a first end of adjustment assembly handle 31 with adjustment assembly handle pivot 32. An adjustment assembly handle detent pin 35 is rigidly connected proximal to the first end of adjustment assembly handle 31. Adjustment assembly locking plate 33 is rigidly connected to machine structural support frame 101 proximal to adjustment assembly handle 31. Adjustment assembly locking plate 33 is constructed with a plurality of adjustment assembly locking plate detent holes 34 for engaging adjustment assembly handle detent pin 35 with adjustment assembly locking plate 33 so as to secure four-bar linkage adjustment and latching assembly 20 and secure a unique configuration of adjustable four-bar linkage assembly 1.

Figure 10:
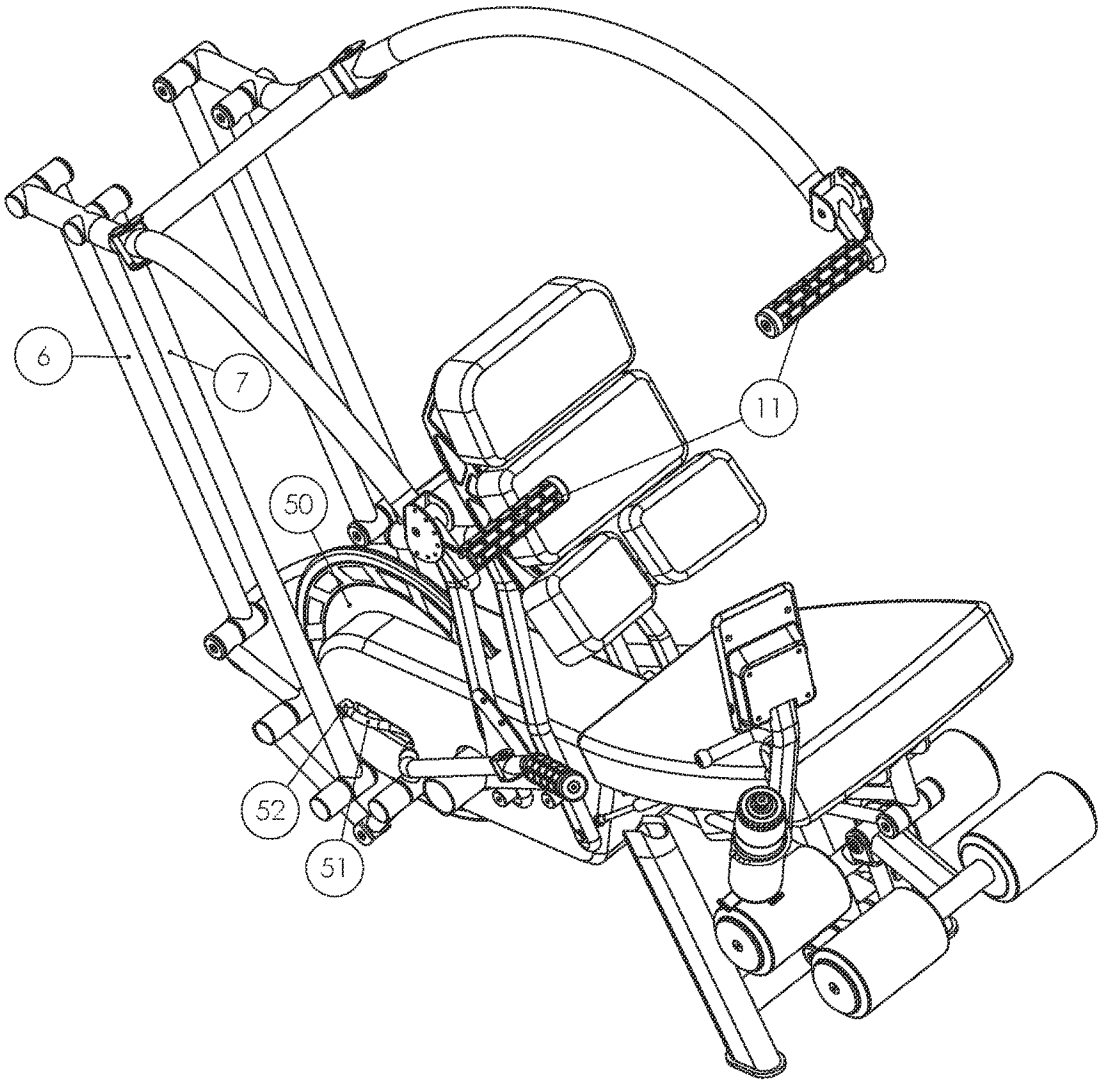
FIG. 10 is a front perspective view of the invention with a portion of the structural support frame removed to better illustrate certain features.

In all embodiments and more clearly illustrated in FIG. 10, adjustable four-bar linkage assembly 1 is operatively connected to a resistance mechanism 50. As illustrated herein, resistance mechanism 50 is a rotational resistance mechanism that is centrally located between a left side adjustable four-bar linkage and a right side adjustable four-bar linkage that are coupled to create adjustable four-bar linkage assembly 1. Said left and right side adjustable four-bar linkages are operatively connected to resistance mechanism 50 with left and right side resistance connection linkage bars 51 that are pivotally connected to left and right side first operational linkage bars 6 with left and right side resistance mechanism connection linkage bar pivots 52. Various types of resistance mechanisms may be mounted at various locations on exercise machine 100 or operatively connected to exercise machine 100 to create resistance to the exercise motion of adjustable four-bar linkage assembly 1 and various force transfer components or combinations of components including but not limited to cables, belts, ropes, pulleys, linkage bars and clutches can be utilized to transfer the force of the exercise motion of adjustable four-bar linkage assembly 1 to a resistance mechanism.

The adjustable four-bar linkage assembly 1 can be adjusted to a plurality of configurations with four-bar linkage adjustment and latching assembly 20 to create a plurality of paths of exercise motions. However, the adjustable four-bar linkage assembly 1 is presented herein as being adjustable with four-bar linkage adjustment and latching assembly 20 to three primary positions of pushing and or pulling exercise motions. The invention is also presented with a rotational resistance mechanism 50 that creates resistance to both the push and pull exercise motions. Though not illustrated, the adjustable four-bar linkage assembly 1 can also be operatively connected to a resistance mechanism that creates resistance in only the push direction or only the pull direction.

Figure 3:
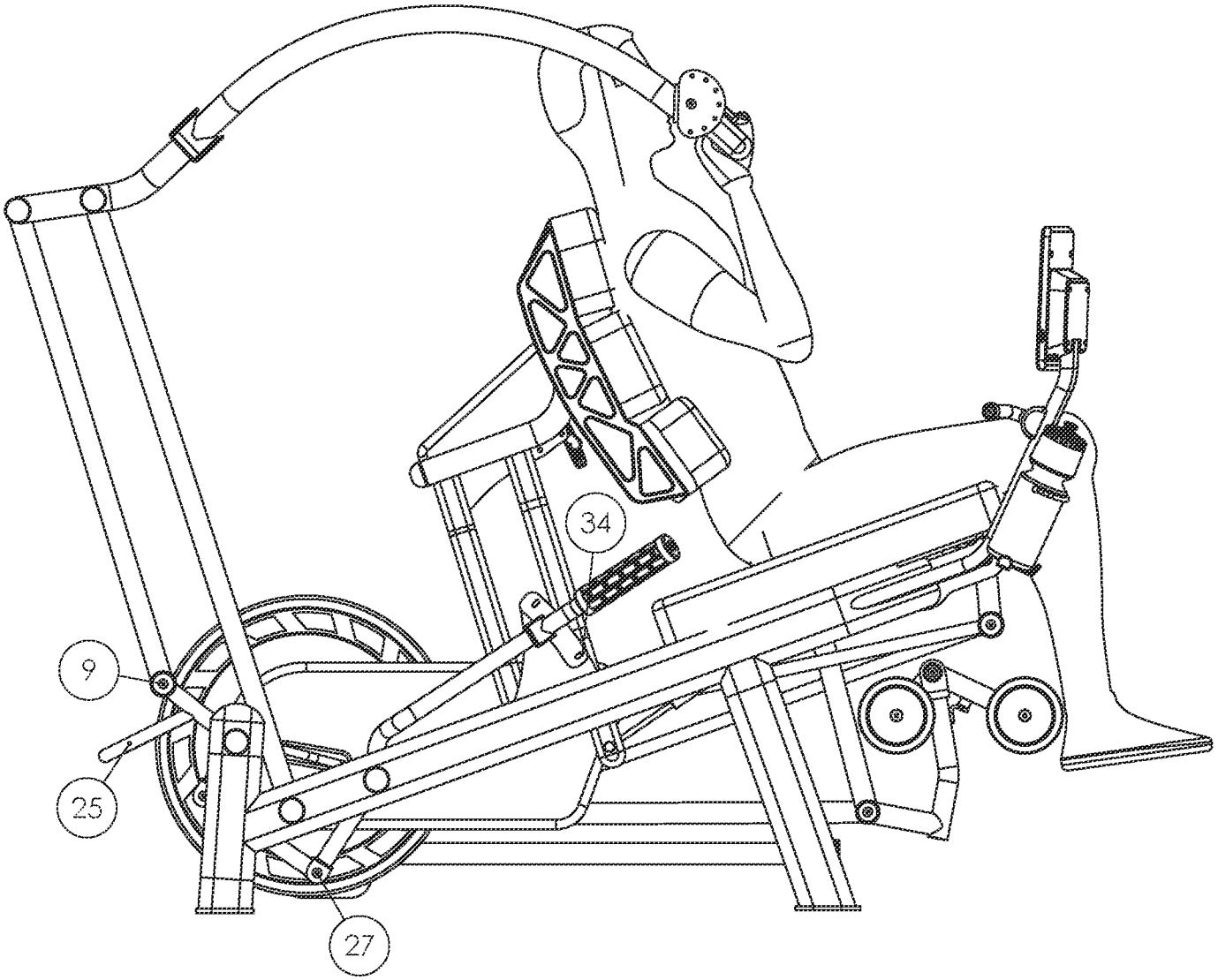
FIG. 3 is a side view of the invention in a second configuration with a user in an exercise position.
Figure 4:
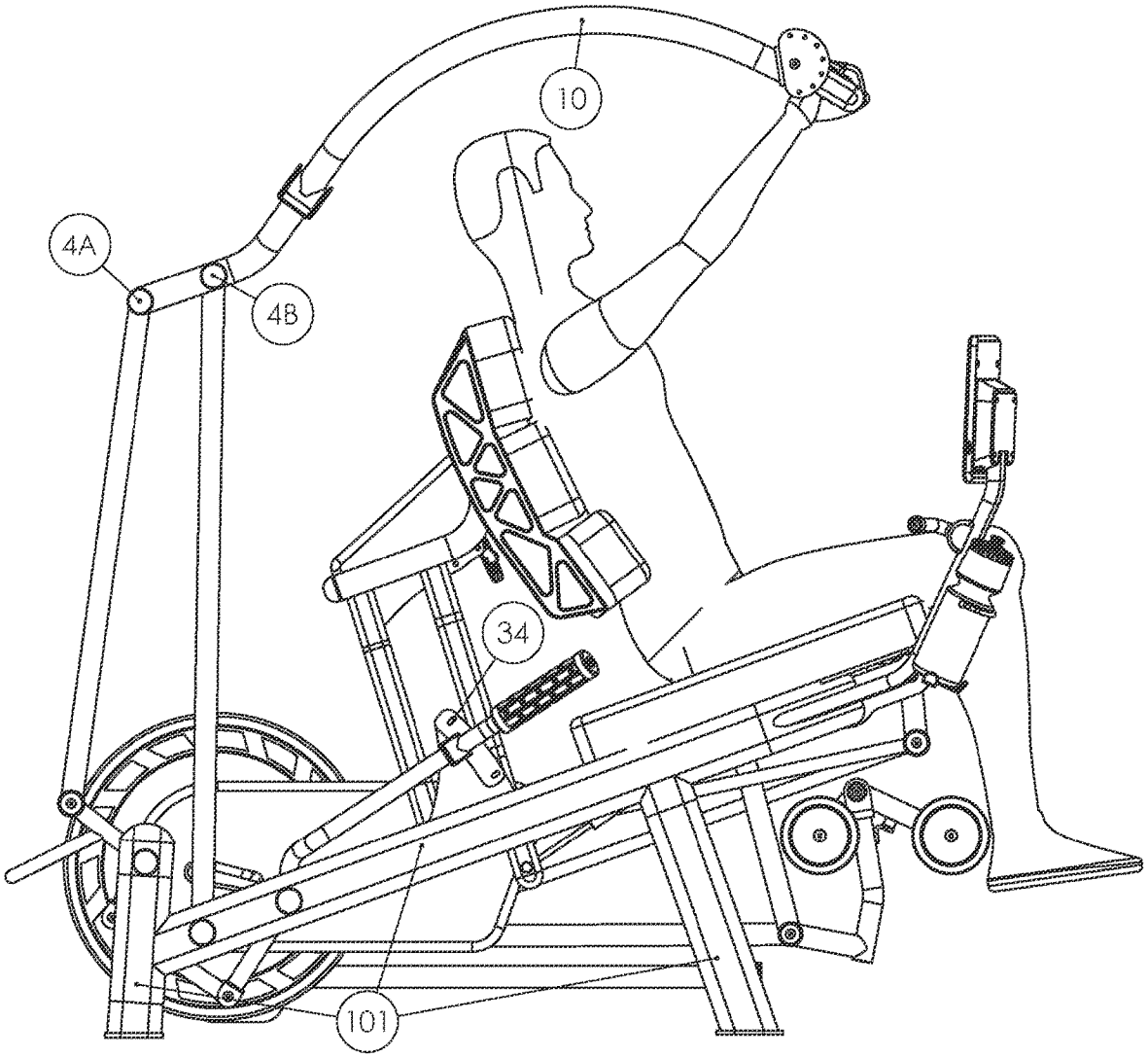
FIG. 4 is a side view of the invention in a second configuration with a user in an exercise position.
Figure 5:
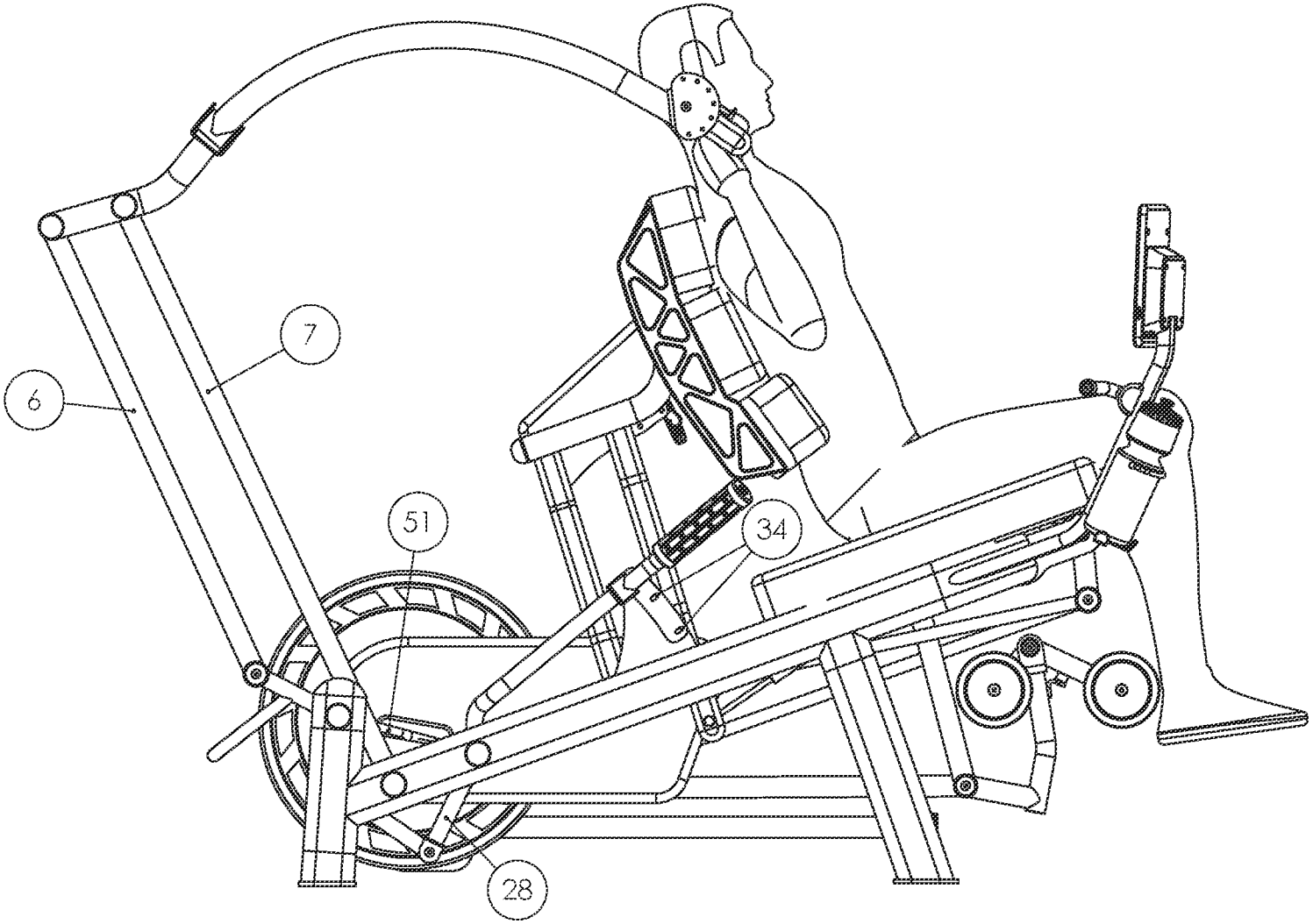
FIG. 5 is a side view of the invention in a third configuration with a user in an exercise position.
Figure 6:
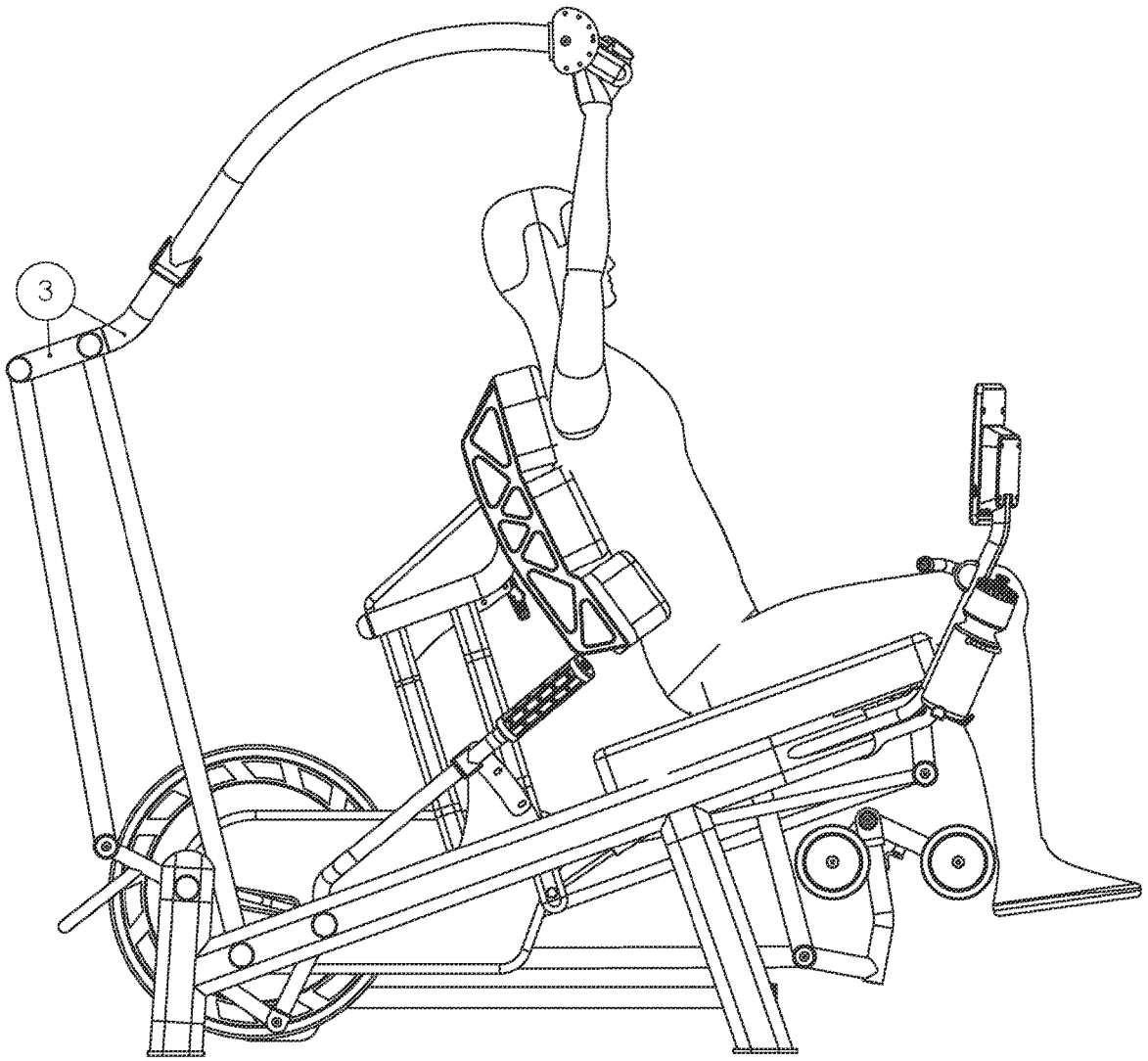
FIG. 6 is a side view of the invention in a third configuration with a user in an exercise position.
Figure 11:
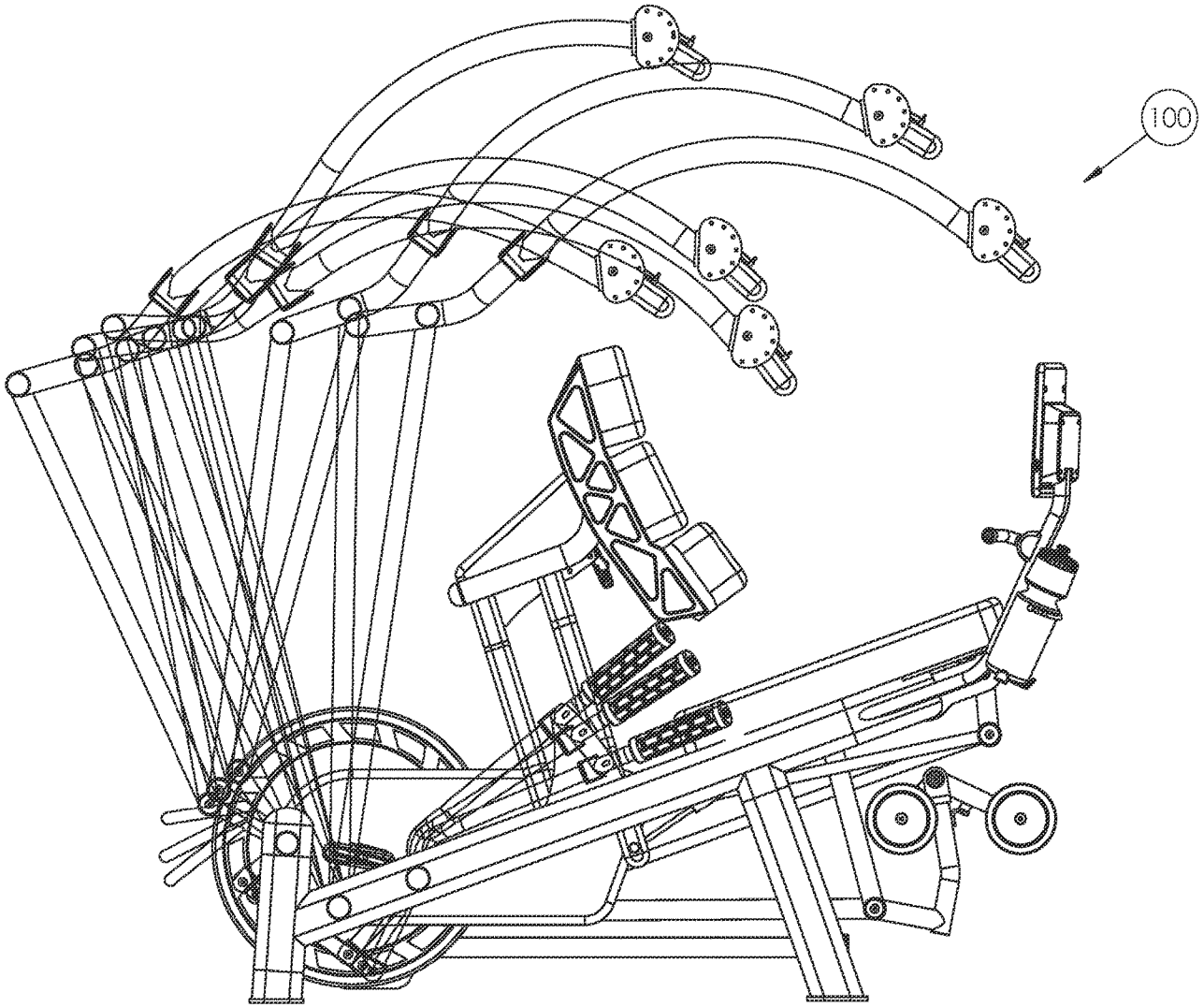
FIG. 11 is a side view of the invention wherein a first, second and third configurations of the invention are overlaid in first and second positions to better illustrate the adjustable function of the invention.

FIGS. 1, 2, 7, 8, and 11 illustrate a first exercise motion configuration of adjustable four-bar linkage assembly 1 wherein adjustment assembly handle detent pin 35 is locked into the bottom adjustment assembly locking plate detent hole 34, which creates a more horizontal trajectory path of motion of user engagement handles 11, which from the seated user position would be consistent with a mid-chest pressing exercise motion in the push direction and a mid-back rowing exercise in the pull direction. FIGS. 3, 4, and 11 illustrate a second exercise motion configuration of adjustable four-bar linkage assembly 1 wherein adjustment assembly handle detent pin 35 is locked into the middle adjustment assembly locking plate detent hole 34, which adjust the adjustable four-bar linkage assembly 1 to a configuration that creates an upper angled trajectory path of motion of user engagement handles 11, which from the seated user position would be consistent with an upper chest pressing exercise motion in the push direction and a upper back rowing exercise in the pull direction. FIGS. 5, 6, and 11 illustrate a third exercise motion configuration of adjustable four-bar linkage assembly 1 wherein adjustment assembly handle detent pin 35 is locked into the top adjustment assembly locking plate detent hole 34, which adjust the adjustable four-bar linkage assembly 1 to a configuration that creates a more vertical trajectory path of motion of user engagement handles 11, which from the seated user position would be consistent with a shoulder pressing exercise motion in the push direction and a back pulldown exercise in the pull direction.

To adjust the adjustable four-bar linkage assembly 1 from the first configuration of a mid-chest press and mid-back rowing exercise motion to the second configuration of an upper chest press and upper back rowing exercise motion, or to the third configuration of a shoulder press and back pulldown exercise motion, or to adjust the adjustable four-bar linkage assembly 1 from the second configuration of a upper chest press and upper back rowing exercise motion to the third configuration of a shoulder press and back pulldown exercise motion, user U grasps adjustment assembly handle 31 and rotates it away from adjustment assembly locking plate 33, which removes adjustment assembly handle detent pin 35 from the bottom or middle adjustment assembly locking plate detent hole 34. Then user U lifts adjustment assembly handle 31 upward to the position of the middle or top adjustment assembly locking plate detent hole 34, causing adjustment assembly lever 30 to move upward and rotate about adjustment assembly lever pivot 29, causing fourth adjustment linkage bar 28 to rotate about adjustment assembly lever pivot 29 and move downward, causing third adjustment linkage bar 26 to move downward and rotate on second movable adjustment pivot 27 and first movable adjustment pivot 24, causing second adjustment linkage bar 23 to move downward while rotating about stationary adjustment pivot 21, causing left and right first adjustment linkage bars 22 to move downward while rotating about stationary adjustment pivots 21, causing adjustable location operational pivots 8 to rotate on adjustable location operational pivot axles 9 and move downward, causing first operational linkage bars 6 to move downward, causing first movable operational pivots 2A to rotate on first movable operational pivot axles 4A, causing third operational linkage bars 3 to rotate about second movable operational pivots 2B, causing user engagement levers 10 to move upward and user engagement handles 11 to move upward to the upper chest press and upper back rowing exercise motion position or the shoulder press and back pulldown exercise motion position. User U then rotates adjustment assembly handle 31 towards adjustment assembly locking plate 33 to engage adjustment assembly handle detent pin 35 into the middle or top adjustment assembly locking plate detent hole to secure adjustable four-bar linkage assembly 1 prior to operating the exercise station.

To adjust the adjustable four-bar linkage assembly 1 from the third configuration of a shoulder press and back pulldown exercise motion to the second configuration of an upper chest press and upper back rowing exercise motion, or to the first configuration of a mid-chest press and mid-back rowing exercise motion, or to adjust the adjustable four-bar linkage assembly 1 from the second configuration of a upper chest press and upper back rowing exercise motion to the first configuration of a mid-chest press and mid-back rowing exercise motion, user U grasps adjustment assembly handle 31 and rotates it away from adjustment assembly locking plate 33, which removes adjustment assembly handle detent pin 35 from the top or middle adjustment assembly locking plate detent hole 34. Then user U lowers adjustment assembly handle 31 downward to the position of the middle or bottom adjustment assembly locking plate detent hole, causing adjustment assembly lever 30 to move downward and rotate about adjustment assembly lever pivot 29, causing fourth adjustment linkage bar 28 to rotate about adjustment assembly lever pivot 29 and move upward, causing third adjustment linkage bar 26 to move upward and rotate on second movable adjustment pivot 27 and first movable adjustment pivot 24, causing second adjustment linkage bar 23 to move upward while rotating about stationary adjustment pivot 21, causing first adjustment linkage bars 22 to move upward while rotating about stationary adjustment pivots 21, causing adjustable location operational pivots 8 to rotate on adjustable location operational pivot axles 9 and move upward, causing first operational linkage bars 6 to move upward, causing first movable operational pivots 2A to rotate on first movable operational pivot axles 4A, causing third operational linkage bars 3 to rotate about second movable operational pivots 2B, causing user engagement levers 10 to move downward and user engagement handles 11 to move downward to the upper chest press and upper back rowing exercise motion position or the mid-chest press and mid-back rowing exercise motion position. User U then rotates adjustment assembly handle 31 towards adjustment assembly locking plate 33 to engage adjustment assembly handle detent pin 35 into the middle or bottom adjustment assembly locking plate detent hole to secure adjustable four-bar linkage assembly 1 prior to operating the exercise station.

To operate a pushing motion exercise with adjustable four-bar linkage assembly 1 on exercise machine 100, user U would enter the machine in a seated position on seat pad 60 and back pads 61. User U would then adjust the configuration of the adjustable four-bar linkage assembly 1 with four-bar linkage adjustment and latching assembly 20 to the desired exercise motion setting and latch it into position as previously described herein. To activate the exercise motion, user U would grasp user engagement handles 11 with a bent arms position while user engagement handles 11 were proximal to back pads 61 and urge user engagement handles 11 forward and or upward to an extended arms position such that user engagement handles 11 are more distal to back pads 61. This motion would cause user engagement levers 10 to move forward and or upward, causing third operational linkage bars 3 to move forward while pivoting about second movable operational pivot 2B on second operational pivot axle 4B, also causing second operational linkage bars 7 to pivot forward while rotating about stationary operational pivots 12, also causing first operational linkage bars 6 to pivot forward while rotating about adjustable location operational pivots 8, also causing first movable operational pivots 2A to rotate on first movable operational pivot axles 4A, wherein the angular orientation of third operational linkage bars 3 control the motion path of user engagement levers 10 and user engagement handles 11 as third operational linkage bar 3 moves through the range of motion created by the adjustable four-bar linkage assembly 1.

To operate a pulling motion exercise with adjustable four-bar linkage assembly 1 on exercise machine 100, user U would enter the machine in a seated position on seat pad 60 and back pads 61. User U would then adjust the configuration of the adjustable four-bar linkage assembly 1 with four-bar linkage adjustment and latching assembly 20 to the desired exercise motion setting and latch it into position as previously described herein. To activate the exercise motion, user U would grasp user engagement handles 11 with an extended arms position while the user engagement handles 11 were distal to back pads 61 and urge user engagement handles 11 rearward and or downward to a bent arms position and such that user engagement handles 11 are more proximal to back pads 61. This motion would cause user engagement levers 10 to move rearward and or downward, causing third operational linkage bars 3 to move rearward while pivoting about second movable operational pivot 2B on second operational pivot axle 4B, also causing second operational linkage bars 7 to pivot rearward while rotating about stationary operational pivots 12, also causing first operational linkage bars 6 to pivot rearward while rotating about adjustable location operational pivots 8, also causing first movable operational pivots 2A to rotate on first movable operational pivot axles 4A, wherein the angular orientation of third operational linkage bars 3 control the motion path of user engagement levers 10 and user engagement handles 11 as third operational linkage bar 3 moves through the range of motion created by the adjustable four-bar linkage assembly 1.

FIGS. 1-11 illustrate the adjustable four-bar linkage assembly 1 operatively connected to an exercise machine 100 with a single user support and multiple exercise stations. However, the adjustable four-bar linkage assembly 1 can also be operatively connected to an exercise machine that comprises one user support and no other exercise stations except for the adjustable four-bar linkage assembly 1, or the adjustable four-bar linkage assembly 1 can also be operatively connected to an exercise machine that has multiple user supports and various exercise stations including the adjustable four-bar linkage assembly 1.

Features and components of the preferred embodiment of the present invention include at least one adjustable four-bar linkage assembly, at least one user engagement feature, at least one four-bar linkage adjustment and latching assembly and at least one resistance mechanism, wherein all of the components are operatively mounted on or connected to an exercise machine to provide multiple resisted push and or pull exercise motions from a single exercise station.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

1 Adjustable four-bar linkage assembly
2A First movable operational pivot
2B Second movable operational pivot
3 Third operational linkage bar
4A First movable operational pivot axle
4B Second movable operational pivot axle
5 Adjustable four-bar linkages connection bar
6 First operational linkage bar
7 Second operational linkage bar
8 Adjustable location operational pivot
9 Adjustable location operational pivot axle
10 User engagement lever
11 User engagement handle
12 Stationary operational pivot
20 Four-bar linkage adjustment and latching assembly
21 Stationary adjustment pivot
22 First adjustment linkage bar
23 Second adjustment linkage bar
24 First movable adjustment pivot
25 Adjustment assembly connection bar
26 Third adjustment linkage bar
27 Second movable adjustment pivot
28 Fourth adjustment linkage bar
29 Adjustment assembly lever pivot
30 Adjustment assembly lever
31 Adjustment assembly handle
32 Adjustment assembly handle pivot
33 Adjustment assembly locking plate
34 Adjustment assembly locking plate detent hole
35 Adjustment assembly handle detent pin
50 Resistance mechanism
51 Resistance mechanism connection linkage
52 Resistance mechanism connection linkage pivot
60 Seat pad
61 Back pads
100 Exercise machine
101 Structural support frame
U User

What is claimed is:

1. An exercise station having an adjustable four-bar linkage assembly operatively connected to a structural support frame of the exercise station, the adjustable four-bar linkage assembly comprising:

a) at least one adjustable location operational pivot which is stationary during operation of the adjustable four-bar linkage assembly;

b) at least one stationary operational pivot rigidly mounted on the structural support frame;

c) at least one first movable operational pivot which moves during operation of the adjustable four-bar linkage assembly;

d) at least one second movable operational pivot which moves during operation of the adjustable four-bar linkage assembly;

e) at least one first operational linkage bar having a first end and a second end wherein the first end of the at least one first operational linkage bar is connected to the at least one adjustable location operational pivot and the second end of the at least one first operational linkage bar is connected to the at least one first movable operational pivot;

f) at least one second operational linkage bar having a first end and a second end wherein the first end of the at least one second operational linkage bar is connected to the at least one stationary operational pivot and the second end of the at least one second operational linkage bar is connected to the at least one second movable operational pivot;

g) at least one third operational linkage bar having a first end and a second end that is pivotably connected at spaced locations to the at least one first movable operational pivot and the at least one second movable operational pivot;

h) at least one linkage adjustment and latching assembly that operatively connects the at least one adjustable location operational pivot to the structural support frame and is capable of locating the at least one adjustable location operational pivot to a plurality of locations relative to the structural support frame and secures the at least one adjustable location operational pivot in a selected location;

i) at least one exercise motion user engagement component, operatively connected to the at least one third operational linkage bar;

wherein during operation of the adjustable four-bar linkage assembly, the location of the at least one adjustable location operational pivot controls the path of motion of the first operational linkage bar, the second operational linkage bar, the third operational linkage bar, and the exercise motion user engagement component, and the location of the at least one adjustable location operational pivot is adjustable to one of a plurality of locations prior to operation of the adjustable four-bar linkage assembly to create one of a plurality of paths of motion of the first operational linkage bar, the second operational linkage bar, the third operational linkage bar, and the exercise motion user engagement component.

2. The exercise station of claim 1, further comprising a resistance mechanism operatively connected to at least one component of the adjustable four-bar linkage assembly, the resistance mechanism provides a one-directional resistance to the adjustable four-bar linkage assembly such that a pushing motion of the adjustable four-bar linkage assembly is resisted by the resistance mechanism or an opposite pulling motion of the adjustable four-bar linkage assembly is resisted by the resistance mechanism.

3. The exercise station of claim 2, further comprising another adjustable four-bar linkage assembly, wherein the two adjustable four-bar linkage assemblies are coupled to form a single unified adjustable four-bar linkage assembly such that the two adjustable four-bar linkage assemblies move in unison.

4. The exercise station of claim 2, further comprising another adjustable four-bar linkage assembly, wherein the two adjustable four-bar linkage assemblies are a left side adjustable four-bar linkage assembly and a right side adjustable four-bar linkage assembly respectively, wherein the two adjustable four-bar linkage assemblies independently are operatively connected to the exercise station such that a user's left hand engages the left side adjustable four-bar linkage assembly and the user's right hand engages the right side adjustable four-bar linkage assembly.

5. The exercise station of claim 1, further comprising a resistance mechanism operatively connected to at least one component of the adjustable four-bar linkage assembly, wherein the resistance mechanism provides a reciprocating resistance to the adjustable four-bar linkage assembly such that a pushing motion of the adjustable four-bar linkage assembly is resisted by the resistance mechanism and an opposite pulling motion of the adjustable four-bar linkage assembly is resisted by the resistance mechanism in a single reciprocating push and return pull exercise motion.

6. The exercise station of claim 3, further comprising another adjustable four-bar linkage assembly, wherein the two adjustable four-bar linkage assemblies are coupled to form a unified single adjustable four-bar linkage assembly such that the two adjustable four-bar linkage assemblies move in unison.

7. The exercise station of claim 5, further comprising another adjustable four-bar linkage assembly, wherein the two adjustable four-bar linkage assemblies are a left side adjustable four-bar linkage assembly and a right side adjustable four-bar linkage assembly, respectively, wherein the two adjustable four-bar linkage assemblies independently are operatively connected to the exercise station such that a user's left hand engages the left side adjustable four-bar linkage assembly and the user's right hand engages the right side adjustable four-bar linkage assembly.

8. An exercise station having an adjustable four-bar linkage assembly operatively connected to a structural support frame of the exercise station, the adjustable four-bar linkage assembly comprising:

a) a first vertically oriented linkage bar with a lower end and an upper end;

b) a second vertically oriented linkage bar with a lower end and an upper end and the lower end of the second vertically oriented linkage bar is pivotally connected to the structural support frame;

c) a horizontally oriented linkage coupling bar pivotally attached to the upper end of the first vertically oriented linkage bar at a first location and pivotally attached at a second spaced location to the upper end of the second vertically oriented linkage bar;

d) a user engagement exercise motion component operatively attached to the horizontally oriented linkage coupling bar; and e) a linkage adjustment and latching assembly that operatively connects the lower end of the first vertically oriented linkage bar to the structural support frame and is capable of locating the first vertically oriented linkage bar to a plurality of locations relative to the structural support frame and secures the first vertically oriented linkage bar in a selected location, wherein during operation of the adjustable four-bar linkage assembly, the location of the first vertically oriented linkage bar controls the path of motion of the first vertically oriented linkage bar, the second vertically oriented linkage bar, the horizontally oriented linkage coupling bar, and the exercise motion user engagement component, and the location of the first vertically oriented linkage bar is adjustable to one of a plurality of locations prior to operation of the adjustable four-bar linkage assembly to create one of a plurality of paths of motion of the first vertically oriented linkage bar, the second vertically oriented linkage bar, the horizontal linkage coupling bar, and the exercise motion user engagement component.

9. The exercise station of claim 8, further comprising a resistance mechanism operatively connected to at least one component of the adjustable four-bar linkage assembly, wherein the resistance mechanism provides one-directional resistance to the adjustable four-bar linkage assembly such that a pushing motion of the adjustable four-bar linkage assembly is resisted by the resistance mechanism or an opposite pulling motion of the adjustable four-bar linkage assembly is resisted by the resistance mechanism.

10. The exercise station of claim 9, further comprising another adjustable four-bar linkage assembly, wherein the two adjustable four-bar linkage assemblies are coupled to form a single unified adjustable four-bar linkage assembly such that the two adjustable four-bar linkage assemblies move in unison.

11. The exercise station of claim 9, further comprising another adjustable four-bar linkage assembly, wherein the two four-bar linkage assemblies are a left side adjustable four-bar linkage assembly and a right side adjustable four-bar linkage assembly, respectively, wherein two adjustable four-bar linkage assemblies independently are operatively connected to the exercise station such that a user's left hand engages the left side adjustable four-bar linkage assembly and a user's right hand engages the right side adjustable four-bar linkage assembly.

12. The exercise station of claim 8, further comprising a resistance mechanism operatively connected to at least one component of the adjustable four-bar linkage assembly, wherein the resistance mechanism provides a reciprocating resistance to the adjustable four-bar linkage assembly such that a pushing motion of the adjustable four-bar linkage assembly is resisted by the resistance mechanism and an opposite pulling motion of the adjustable four-bar linkage assembly is resisted by the resistance mechanism in a single reciprocating push and return pull exercise motion.

13. The exercise station of claim 12, further comprising another adjustable four-bar linkage assembly, wherein the two adjustable four-bar linkage assemblies are coupled to form a single unified adjustable four-bar linkage assembly such that the two adjustable four-bar linkage assemblies move in unison.

14. The exercise station of claim 12, further comprising another adjustable four-bar linkage assembly, wherein the two adjustable four-bar linkage assemblies are a left side adjustable four-bar linkage assembly and a right side adjustable four-bar linkage assembly, respectively, wherein the two adjustable four-bar linkage assemblies independently are operatively connected to the exercise station such that a user's left hand engages the left side adjustable four-bar linkage assembly and the user's right hand engages the right side adjustable four-bar linkage assembly.

* * * * *